US009188136B2

(12) United States Patent
Colson et al.

(10) Patent No.: US 9,188,136 B2
(45) Date of Patent: Nov. 17, 2015

(54) FAN ROTOR WITH COOLING HOLES

(75) Inventors: Darryl A. Colson, West Suffield, CT (US); Brent J. Merritt, Southwick, MA (US); Danielle Mansfield-Marcoux, Enfield, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 903 days.

(21) Appl. No.: 13/279,588

(22) Filed: Oct. 24, 2011

(65) Prior Publication Data

US 2013/0101436 A1 Apr. 25, 2013

(51) Int. Cl.
*F04D 29/32* (2006.01)
*F04D 29/58* (2006.01)

(52) U.S. Cl.
CPC ..... *F04D 29/329* (2013.01); *F04D 29/5806* (2013.01); *Y10T 29/49327* (2013.01)

(58) Field of Classification Search
CPC ..... F04D 19/002; F04D 29/18; F04D 29/181; F04D 29/20; F04D 29/26; F04D 29/263; F04D 29/32; F04D 29/321; F04D 29/325; F04D 29/329; F04D 29/5806
USPC ..... 415/175, 176; 416/244 R, 90 R, 93 R, 95, 416/97 R
See application file for complete search history.

(56) References Cited

U.S. PATENT DOCUMENTS 1,940,466 A 12/1933 Sneed
2,527,229 A 10/1950 Roubal
2,752,515 A 6/1956 Baudry et al.
3,410,029 A 11/1968 Savage
3,433,020 A 3/1969 Earle, Jr. et al.
3,588,044 A 6/1971 Reichrath et al.
3,763,835 A 10/1973 Miller et al.
3,915,024 A 10/1975 Mort
3,949,550 A 4/1976 Albrecht et al.
3,999,872 A 12/1976 Allison
4,012,154 A 3/1977 Durwin et al.
4,439,106 A 3/1984 Ferris et al.
4,511,193 A 4/1985 Geczy
4,543,785 A 10/1985 Patrick
4,583,911 A * 4/1986 Braun ..... 415/116
4,979,872 A 12/1990 Myers et al.
5,239,815 A 8/1993 Barcza
5,505,587 A 4/1996 Ghetzler
5,529,316 A 6/1996 Mattila
5,683,184 A 11/1997 Striedacher et al.
6,299,077 B1 10/2001 Harmon et al.
6,380,647 B2 4/2002 Hayashi et al.
6,698,933 B2 3/2004 Lau
6,926,490 B2 8/2005 McAuliffe et al.
(Continued)

OTHER PUBLICATIONS

Colson et al., U.S. Appl. No. 13/279,529, filed Oct. 24, 2011.
(Continued)

*Primary Examiner* — Edward Look
*Assistant Examiner* — Juan G Flores
(74) *Attorney, Agent, or Firm* — Kinney & Lange, P.A.

(57) ABSTRACT

A disc for a fan rotor (with a pilot to connect to a rotating shaft, a hub and a plurality of blades) includes a flat circular portion connecting to the pilot at an inner edge and to the hub at an outer edge; a plurality of first circular cooling holes of a first diameter located around the inner edge of the disc; and a plurality of second circular cooling holes of a second diameter located around the outer edge of the disc, wherein the second diameter is larger than the first diameter.

7 Claims, 3 Drawing Sheets

(56) References Cited

U.S. PATENT DOCUMENTS

| | | | | |
|---|---|---|---|---|
| 6,928,963 | B2 | 8/2005 | Karanik | |
| 6,966,174 | B2 | 11/2005 | Paul | |
| 7,165,939 | B2 | 1/2007 | Chen et al. | |
| 7,342,332 | B2 | 3/2008 | McAuliffe et al. | |
| 7,345,386 | B2 * | 3/2008 | Dano et al. | 310/61 |
| 7,394,175 | B2 | 7/2008 | McAuliffe et al. | |
| 7,397,145 | B2 | 7/2008 | Struve et al. | |
| 7,757,502 | B2 | 7/2010 | Merritt et al. | |
| 7,952,241 | B2 | 5/2011 | Kato et al. | |
| 2002/0171218 | A1 | 11/2002 | Bell | |
| 2006/0061221 | A1 | 3/2006 | McAuliffe et al. | |
| 2010/0033041 | A1 * | 2/2010 | Watanabe et al. | 310/63 |
| 2010/0055383 | A1 | 3/2010 | Schalla et al. | |

OTHER PUBLICATIONS

Colson et al., U.S. Appl. No. 13/279,538, filed Oct. 24, 2011.
Rosen et al., U.S. Appl. No. 13/279,488, filed Oct. 24, 2011.
Binek et al., U.S. Appl. No. 13/279,497, filed Oct. 24, 2011.
Binek et al., U.S. Appl. No. 13/279,508, filed Oct. 24, 2011.
Chrabascz et al., U.S. Appl. No. 13/279,523, filed Oct. 24, 2011.
Chrabascz et al., U.S. Appl. No. 13/279,534, filed Oct. 24, 2011.
Rosen et al., U.S. Appl. No. 13/279,576, filed Oct. 24, 2011.

* cited by examiner

FAN ROTOR WITH COOLING HOLES

BACKGROUND

The present invention relates to an environmental control system. In particular, the invention relates to a ram air fan assembly for an environmental control system for an aircraft.

An environmental control system (ECS) aboard an aircraft provides conditioned air to an aircraft cabin. Conditioned air is air at a temperature, pressure, and humidity desirable for aircraft passenger comfort and safety. At or near ground level, the ambient air temperature and/or humidity is often sufficiently high that the air must be cooled as part of the conditioning process before being delivered to the aircraft cabin. At flight altitude, ambient air is often far cooler than desired, but at such a low pressure that it must be compressed to an acceptable pressure as part of the conditioning process. Compressing ambient air at flight altitude heats the resulting pressurized air sufficiently that it must be cooled, even if the ambient air temperature is very low. Thus, under most conditions, heat must be removed from air by the ECS before the air is delivered to the aircraft cabin. As heat is removed from the air, it is dissipated by the ECS into a separate stream of air that flows into the ECS, across heat exchangers in the ECS, and out of the aircraft, carrying the excess heat with it. Under conditions where the aircraft is moving fast enough, the pressure of air ramming into the aircraft is sufficient to move enough air through the ECS and over the heat exchangers to remove the excess heat.

While ram air works well under normal flight conditions, at lower flight speeds, or when the aircraft is on the ground, ram air pressure is too low to provide enough air flow across the heat exchangers for sufficient heat removal from the ECS. Under these conditions, a fan within the ECS is employed to provide the necessary airflow across the ECS heat exchangers. This fan is called a ram air fan.

As with any system aboard an aircraft, there is great value in an improved ram air fan that includes innovative components designed to improve the operational efficiency of the ram air fan or to reduce its weight.

SUMMARY

A disc for a fan rotor (with a pilot to connect to a rotating shaft, a hub and a plurality of blades) includes a flat circular portion connecting to the pilot at an inner edge and to the hub at an outer edge; a plurality of first circular cooling holes of a first diameter located around the inner edge of the disc; and a plurality of second circular cooling holes of a second diameter located around the outer edge of the disc, wherein the second diameter is larger than the first diameter.

A method of installing a rotor to be rotated by a thrust shaft within a fan system includes shrinking the fan rotor to have a smaller diameter than its natural state; placing the thrust shaft around the rotor; and allowing the fan rotor to expand so that the rotor is secured onto the thrust shaft to rotate with the shaft. The rotor includes a circular disc portion with a plurality of small cooling holes at an inner edge and a plurality of large cooling holes at an outer edge.

DETAILED DESCRIPTION

Figure 1:
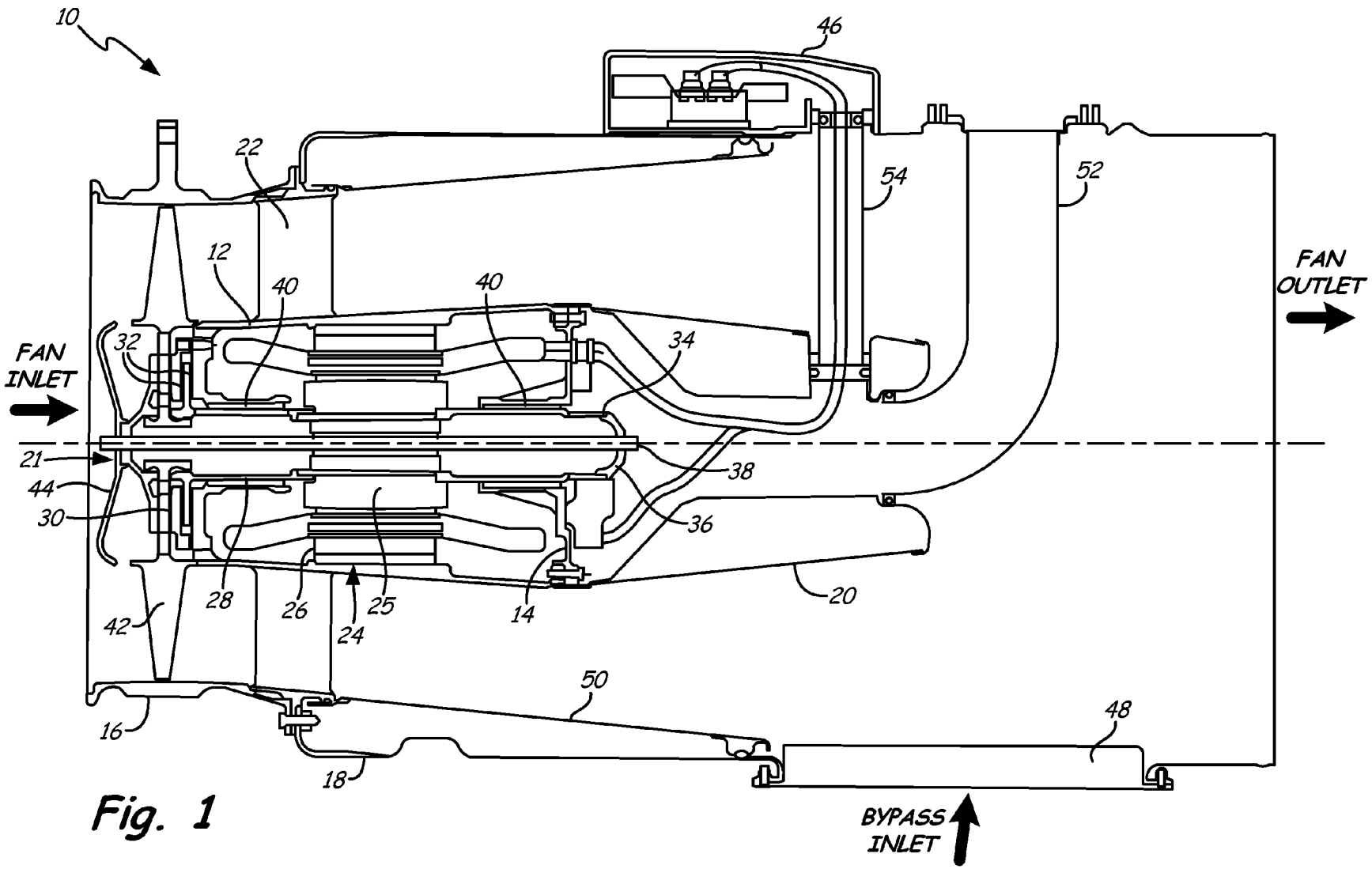
FIG. 1 is cross-sectional view of a ram air fan assembly.

FIG. 1 illustrates a ram fan air assembly incorporating the present invention. Ram air fan assembly 10 includes fan housing 12, bearing housing 14, inlet housing 16, outer housing 18, and inner housing 20. Fan housing 12 includes fan struts 22, motor 24 (including motor rotor 25 and motor stator 26), thrust shaft 28, thrust plate 30, and thrust bearings 32. Bearing housing 14 includes journal bearing shaft 34 and shaft cap 36. Fan housing 12 and bearing housing 14 together include tie rod 38 and journal bearings 40. Inlet housing 16 contains fan rotor 42 and inlet shroud 44, in addition to a portion of tie rod 38. Outer housing 18 includes terminal box 46 and plenum 48. Within outer housing 18 are diffuser 50, motor bearing cooling tube 52, and wire transfer tube 54. A fan inlet is a source of air to be moved by ram air fan assembly 10 in the absence of sufficient ram air pressure. A bypass inlet is a source of air to that moves through ram air fan assembly 10 when sufficient ram air pressure is available.

As illustrated in FIG. 1, inlet housing 16 and outer housing 18 are attached to fan housing 12 at fan struts 22. Bearing housing 14 is attached to fan housing 12 and inner housing 20 connects motor bearing cooling tube 52 and wire transfer tube 54 to bearing housing 14. Motor bearing cooling tube 52 connects inner housing 20 to a source of cooling air at outer housing 18. Wire transfer tube 54 connects inner housing 20 to outer housing 18 at terminal box 46. Motor stator 26 and thrust plate 30 attach to fan housing 12. Motor rotor 25 is contained within motor stator 26 and connects journal bearing shaft 34 to thrust shaft 28. Journal bearing shaft 34, motor rotor 25, and thrust shaft 28 define an axis of rotation for ram fan assembly 10. Fan rotor 42 is attached to thrust shaft 28 with tie rod 38 extending along the axis of rotation from shaft cap 36 at the end of journal bearing shaft 34 through motor rotor 25, thrust shaft 28, and fan rotor 42 to inlet shroud 44. Nuts (not shown) secure shaft cap 36 to journal bearing shaft 34 on one end of tie rod 38 and inlet shroud 44 to fan rotor 42 at opposite end of tie rod 38. Thrust plate 30 and fan housing 12 contain a flange-like portion of thrust shaft 28, with thrust bearings 32 positioned between the flange-like portion of thrust shaft 28 and thrust plate 30; and between the flange-like portion of thrust shaft 28 and fan housing 12. Journal bearings 40 are positioned between journal bearing shaft 24 and bearing housing 14; and between thrust shaft 28 and fan housing 12. Inlet shroud 44, fan rotor 42, and a portion of fan housing 12 are contained within inlet housing 16. Diffuser 50 is attached to an inner surface of outer housing 18. Plenum 48 is a portion of outer housing 18 that connects ram air fan assembly 10 to the bypass inlet. Inlet housing 16 is connected to the fan inlet and outer housing 18 is connected to the fan outlet.

In operation, ram air fan assembly 10 is installed into an environmental control system aboard an aircraft and connected to the fan inlet, the bypass inlet, and the fan outlet. When the aircraft does not move fast enough to generate sufficient ram air pressure to meet the cooling needs of the ECS, power is supplied to motor stator 26 by wires running from terminal box 46, through wire transfer tube 54, inner housing 20, and bearing housing 14. Energizing motor stator 26 causes rotor 24 to rotate about the axis of rotation of ram fan assembly 10, rotating connected journal bearing shaft 34 and thrust shaft 28. Fan rotor 42 and inlet shroud 44 also rotate by way of their connection to thrust shaft 28. Journal bearings 40 and thrust bearings 32 provide low friction support for the rotating components. As fan rotor 42 rotates, it moves air from the fan inlet, through inlet housing 20, past fan struts 22 and into the space between fan housing 12 and outer housing 18, increasing the air pressure in outer housing 18. As the air moves through outer housing 18, it flows past diffuser 50 and inner housing 20, where the air pressure is reduced due to the shape of diffuser 50 and the shape of inner housing 20. Once past inner housing 20, the air moves out of outer housing 18 at the fan outlet.

Components within bearing housing 14 and fan housing 12, especially thrust bearings 32, journal bearings 40 and motor 24; generate significant heat and must be cooled. Cooling air is provided by motor bearing cooling tube 52 which directs a flow of cooling air to inner housing 20. Inner housing 20 directs flow of cooling air to bearing housing 14, where it flows past components in bearing housing 14 and fan housing 12, cooling bearings 32, 40 and motor components. Cooling air then exits fan housing 12 through cooling holes in rotor 42.

Figure 2A:
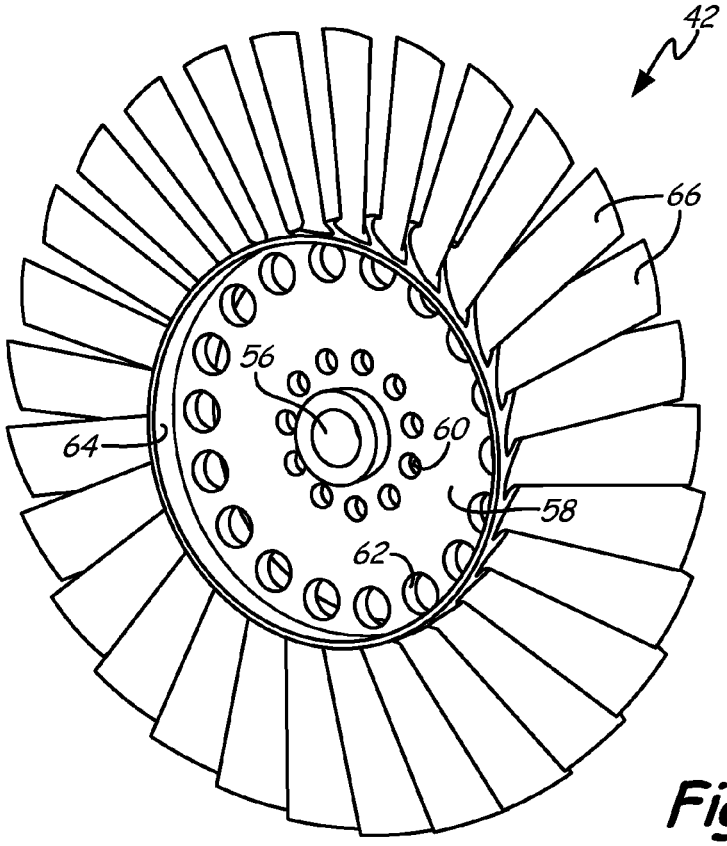
FIG. 2A shows a perspective view of a fan rotor.
Figure 2B:
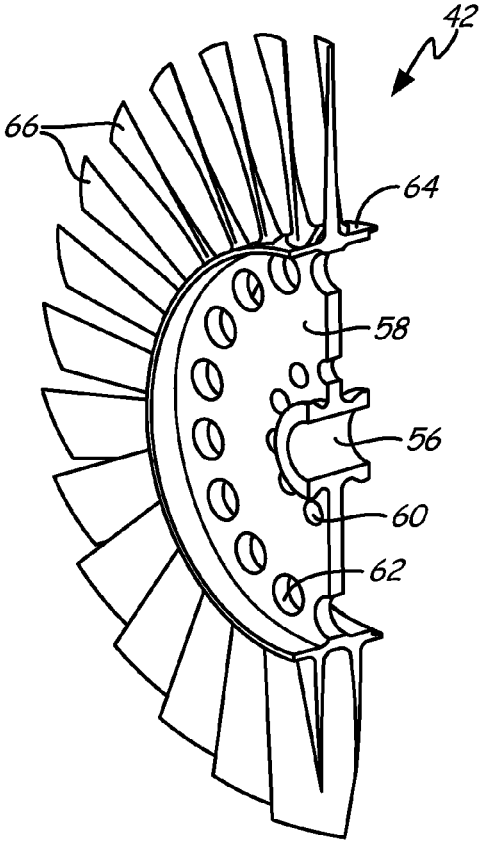
FIG. 2B shows a cross sectional view of FIG. 2A.
Figure 2C:
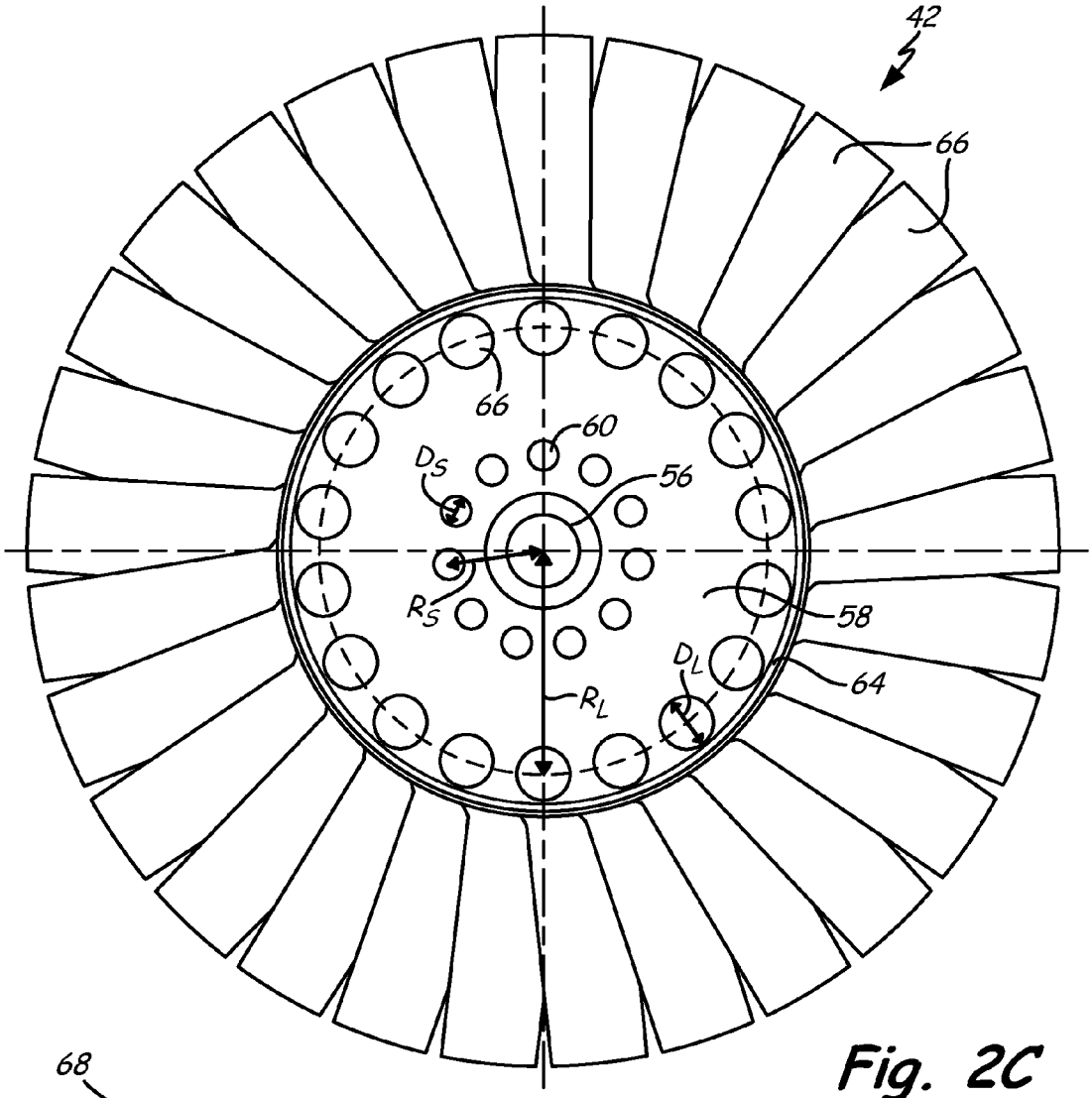
FIG. 2C shows a front view FIG. 2A.

FIG. 2A shows a perspective view of fan rotor 42. FIG. 2B shows a cross sectional view of FIG. 2A, and FIG. 2C shows a front view FIG. 2A. Fan rotor 42 includes pilot 56, disc 58, hub 64 and blades 66. Disc 58 is flat and circular, and includes small (first) cooling holes 60, with first diameter $D_S$ spaced $R_S$ distance from center of disc 58; and large (second) cooling holes 62 with second diameter $D_L$ spaced $R_L$ distance from center of disc 58. Cooling holes 60 and 62 are circular in shape. Rotor 42 can be machined from one workpiece, with cooling holes 60, 62 machined out individually.

As mentioned earlier, when fan 10 is in operation, pilot 56 securely connects to thrust shaft 28. Rotor 42 then rotates with thrust shaft 28 (driven by motor 24), causing blades 66 pull air into fan 10.

Small cooling holes 60 are equally spaced around inner edge of disc 58, close to pilot 56. Small cooling holes 60 have a diameter $D_S$ of about 0.370 inches (9.398 mm) to about 0.380 inches (9.652 mm), and are positioned at a distance $R_S$ of about 2.375 inches (60.325 mm) from the disc center. Large cooling holes 62 are equally spaced around outer edge of disc 58. Large cooling holes 62 have a diameter $D_L$ of about 0.651 inches (16.535 mm) to about 0.661 inches (16.789 mm), and are positioned at a distance $R_L$ of about 5.530 inches (140.462 mm) from the disc center. In this embodiment, disc 58 contains 18 large cooling holes 62 and 11 small cooling holes 60.

Small cooling holes 60 and large cooling holes 62 control the cooling air flow through inner cooling area, which consists of bearing housing 14 and fan housing 12. As mentioned in relation to FIG. 1, motor bearing cooling tube 52 delivers cooling air to inner housing 20, which sends the cooling air to bearing housing 14 and then fan housing 12. Motor 24 heats to significant temperatures during operation and requires large amounts of cooling. This cooling is critical to performance and reliability. Large supplies of cooling air are required to maintain a high level of motor 24 performance and ensure a long life. Cooling air is also required to ensure a long life for thrust bearings 32 and journal bearings 40, though not as much cooling air as is required for motor 24. Placing a plurality of large cooling holes 62 at locations around outer edge of disc 58 encourages large amounts of cooling airflow around outer locations of fan housing 12 and bearing housing 14, where motor 24 is located. Placing a plurality of smaller cooling holes 62 at locations around inner edge of disc 58 allows for cooling air flow through the locations of thrust bearings 32 and journal bearings 40, though the smaller size of holes 60 encourages more flow toward outer edges to cool down motor 24. Thus, placing large cooling holes 62 and small cooling holes 60 at selective locations around disc 58 allows for controlling of airflow to cool different components at different levels depending on how much cooling each component requires.

Figure 3:
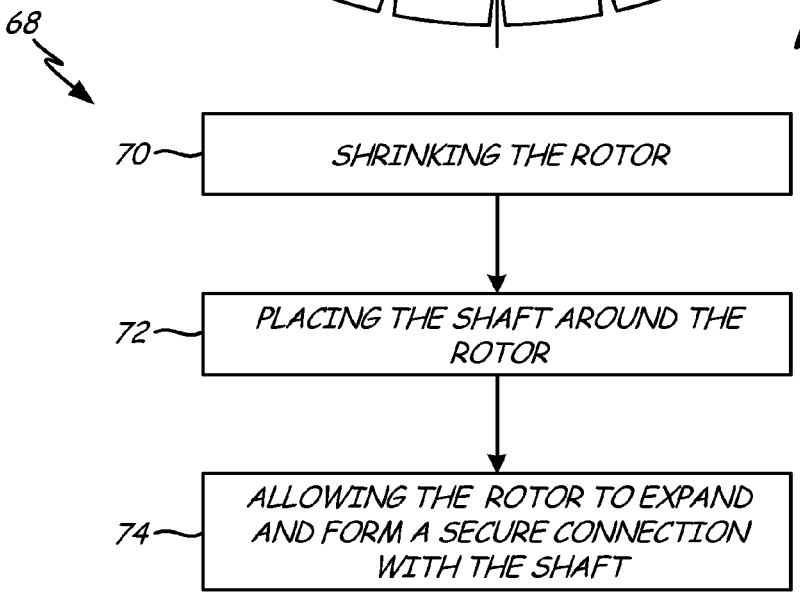
FIG. 3 shows a block diagram of a method for installing a rotor into a ram air fan.

FIG. 3 shows a block diagram of a method for installing a rotor into a ram air fan. In installation, pilot 56 seals to thrust shaft 28 (FIG. 1) to rotate with thrust shaft 28. This connection can be an interference fit, meaning that the diameter of rotor 42 is larger than the diameter of thrust shaft 28. Method 68 includes steps of: shrinking rotor 42 (step 70), placing thrust shaft 28 around rotor 42 (step 72) and allowing rotor 42 to expand to form a secure connection with shaft 28 (step 74).

Shrinking rotor 42 (step 70) can be done in variety of ways. One way can be use immerse rotor 42 in liquid nitrogen, causing rotor 42 to freeze and contract.

Placing rotor 42 pilot 56 on thrust shaft 28 (step 72) is done while rotor 42 has been shrunk by step 70. Alternatively, a hydraulic press could be used to simply push rotor 42 onto thrust shaft 28 (which would make steps 70 and 74 unnecessary).

Allowing rotor 42 to expand and form a secure connection with thrust shaft 28 (step 74) is done by allowing rotor 42 to return to its normal state after thrust shaft 28 has been placed at the desired location around rotor 42. If rotor 42 has been shrunk using liquid nitrogen, this step can be done by placing the parts in an area with warmer temperatures. Step 74 forms a secure connection between rotor 42 and thrust shaft 28 due to the diameter of rotor 42 being larger than the diameter of thrust shaft 28. Thus, rotor 42 holds securely to thrust shaft 28 and rotates with thrust shaft 28 when ram air fan 10 is in operation.

In summary, the addition of a plurality of large cooling holes around an outer edge and small cooling holes around an inner edge of a disc for a rotor allows for the control in airflow in an inner cooling system of a fan. This controlling of the airflow allows for the cooling of different inner components, such as a motor and bearings, at different levels related to the level of cooling required for the individual components by encouraging more airflow through an area which needs substantial cooling (where a motor is located) and allowing some airflow through areas which need some, but less cooling (where bearings are located).

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A cooling flow system for a motor and bearings of a ram air fan, the system comprising:

an inner cooling area housing the motor, bearings and tie rod to intake air; and a rotor connected to the tie rod and comprising:

a pilot to connect to the tie rod for rotating the rotor;

a circular flat monolithic disc portion extending around the pilot, the disc with a plurality of large circular holes located around an outer edge of the circular disc portion to control the flow of air cooling the motor and a plurality of small circular holes located around the pilot to control the flow of air cooling the bearings, wherein the plurality of large circular holes comprises 18 cooling holes equally spaced around the center of the disc, and wherein the plurality of small circular holes comprises 11 cooling holes equally spaced around the center of the disc;

a hub connecting to the outer edge of the circular disc portion; and a plurality of blades attached around the hub.

2. The system of claim 1, wherein the plurality of small holes are located about 2.375 inches (60.325 mm) from the disc center.

3. The system of claim 1, wherein the plurality of small holes have a diameter of 0.370 inches (9.398 mm) to 0.380 inches (9.652 mm).

4. The system of claim 1, wherein the plurality of small holes and the plurality of large holes are equally spaced around the center of the disc.

5. The system of claim 1, wherein the plurality of large holes are located about 5.530 inches (140.462 mm) from the disc center.

6. The system of claim 1, wherein the plurality of large holes have a diameter of 0.651 inches (16.535 mm) to 0.661 inches (16.789 mm).

7. A method of installing a rotor to be rotated by a thrust shaft within a fan system, the method comprising:

shrinking the rotor to have a smaller diameter than its natural state;

placing the thrust shaft around the rotor; and allowing the rotor to expand so that the rotor is secured onto the thrust shaft to rotate with the thrust shaft, wherein the rotor includes a circular disc portion with a plurality of small cooling holes at an inner edge and a plurality of large cooling holes at an outer edge.

* * * * *